United States Patent [19]

Wolters et al.

[11] 4,418,484

[45] Dec. 6, 1983

[54] METHOD OF DREDGING AND DREDGING IMPLEMENT

[75] Inventors: Tjako A. Wolters, Zeist; Gerard W. H. Goedegebuure, Amstelveen; Bartholomeus M. de Witt, Amsterdam, all of Netherlands; Constantius H. M. Veltman, Safat, Kuwait

[73] Assignees: Ballast-Nedam Groep N.V., Amstelveen; Amsterdamse Ballast Bagger en Grond (Amsterdam Ballast Dredging) B.V.; Scheepswerf en Machinefabriek "De Liesbosch" B.V., Nieuwegein, all of Netherlands

[21] Appl. No.: 211,925

[22] Filed: Dec. 1, 1980

[30] Foreign Application Priority Data

Nov. 15, 1979 [NL] Netherlands ..... 7908362
Nov. 29, 1979 [EP] European Pat. Off. ..... 79200703.1

[51] Int. Cl.[3] ..... E02F 3/88
[52] U.S. Cl. ..... 37/63; 37/195
[58] Field of Search ..... 37/61, 62, 63, 78, 58, 37/59, 195; 299/17; 405/163; 175/67

[56] References Cited

U.S. PATENT DOCUMENTS

| | | | |
|---|---|---|---|
| 2,204,584 | 6/1940 | Flower | 37/55 X |
| 2,318,587 | 5/1943 | Andrews, Jr. | 37/78 |
| 2,896,341 | 7/1959 | Chance | 39/58 |
| 3,528,704 | 9/1970 | Johnson, Jr. | 299/17 X |
| 3,730,592 | 5/1973 | Wenneborg et al. | 175/67 X |
| 3,877,159 | 4/1975 | Boomstra | 37/64 |
| 4,052,801 | 10/1977 | Smith | 37/64 |
| 4,117,689 | 10/1978 | Martin | 37/63 X |

FOREIGN PATENT DOCUMENTS

| | | | |
|---|---|---|---|
| 9516 | 4/1980 | European Pat. Off. . | |
| 2145758 | 3/1972 | Fed. Rep. of Germany | 37/63 |
| 2015618 | 9/1979 | United Kingdom . | |
| 242055 | 9/1969 | U.S.S.R. | 37/63 |
| 319688 | 1/1972 | U.S.S.R. | 37/62 |
| 196627 | 6/1977 | U.S.S.R. | 37/63 |

*Primary Examiner*—Clifford D. Crowder
*Attorney, Agent, or Firm*—Diller, Ramik & Wight

[57] ABSTRACT

When sucking ground material through a lying, elongated suction slot moved over the ground, the water stream for suctioning this ground material is adjusted in dependence upon the types of ground material to be fluidized.

10 Claims, 33 Drawing Figures

METHOD OF DREDGING AND DREDGING IMPLEMENT

Figure 1:
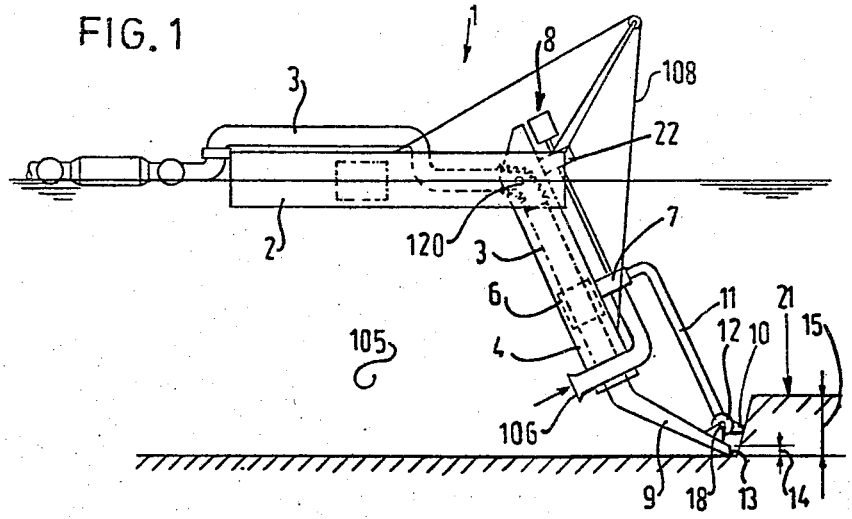

The invention relates to a method of sucking up a layer of ground material, for example, sand from a subaqueous ground through a lying, elongated suction slot of a suction head moved along the ground, the ground material of said layer being fluidized prior to suction by means of at least one water stream emanating at a higher level than the suction slot from a pressurized water supply and directed towards said ground material and distributed in a direction parallel to the suction slot.

This method is known from "World Dredging and Marine Construction", September 1979, pages 34 and 35. In this known method the ground immediately above the suction head is loosened with the aid of fixed water jets. The water jet tubes have a fixed passage and occupy a fixed position on the suction head. Ground that can be dredged up only with difficulty, such as loam and clay and strongly packed sand cannot be satisfactorily loosened with the aid of the water jet.

The purpose of the invention is to effectively suck up ground that can be dredged up only with difficulty and preferably so that a flat bottom is left. According to the invention this is achieved by adjusting the specific energy of the water stream in dependence of the conditions of the ground material. Adaptation to suction depth and height of the layer of the ground to be dredged up is also possible when, in addition, the direction of the water stream is set as a function of the condition of the ground material.

When a high specific energy of the water stream is adjusted, the direction of the water stream is repeatedly swung to and fro, so that a fairly large thickness of ground layer can yet be worked with a fine, strong jet.

A further preferred method permits of working a broad region at the side of a dredger by moving the suction head along consecutive paths successively in opposite directions transverse of the longitudinal direction of a floating body carrying the suction head, the opening of the suction head being disposed at the front of each next following path—viewed in the direction of the path.

In order to obtain a bottom with a prescribed inclination the suction head is held parallel to the prescribed inclination, whilst the direction and the specific energy of the water stream, as well as the width of the suction slot, are adjusted in dependence upon the inclination.

The invention furthermore relates to and provides a dredging implement comprising a floating body, a transport conduit for the dredged material connected with said floating body, a water supply conduit provided with a water pump, a broad suction head having a long suction slot connected with the end of the ground transport conduit and suspended to the floating body by suspension means and a plurality of water jet tubes distributed along the suction slot and communicating with the water supply conduit. For carrying out the method according to the invention this dredging implement is characterized by a plurality of water jet tubes providing a water stream having adjusting means for setting the specific energy of the water stream.

In order to further improve the directional treatment of the ground to be dredged a further embodiment of the dredger in accordance with the invention is characterized by control-means for the controlled supply of water to the water jet tubes with adjustable energy.

A further development of a preferred dredger according to the invention comprises means for cutting up the ground, which may contain occluded clay lenses or similar materials dredged up only with difficulty, which can be removed by a moving water jet or by mechanical agency in accordance with two further developments of a preferred dredger embodying the invention.

The aforesaid and further features of the invention will be described more fully with reference to a drawing.

The drawing shows schematically in

Figure 2:
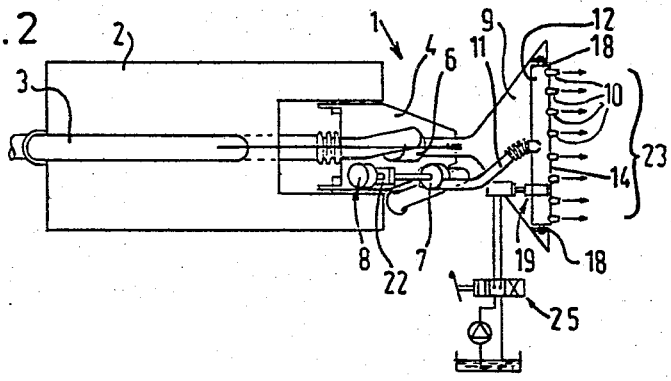

FIGS. 1 and 2 a side elevation and plan view respectively of a dredger embodying the invention.

FIGS. 3 to 6 and FIGS. 8 and 11 the dispostion of water jet tubes at the suction head of a dredger as shown in FIG. 1.

Figure 7:
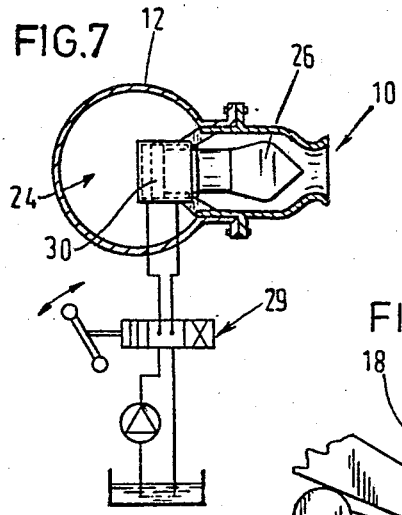
Figure 9:
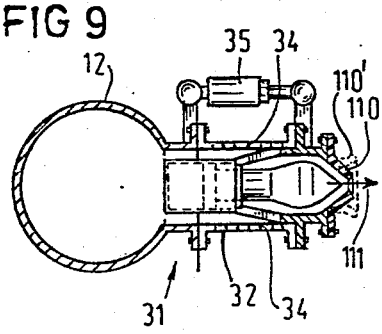
Figure 10:
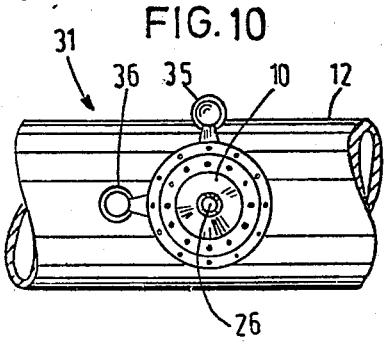
Figure 12:
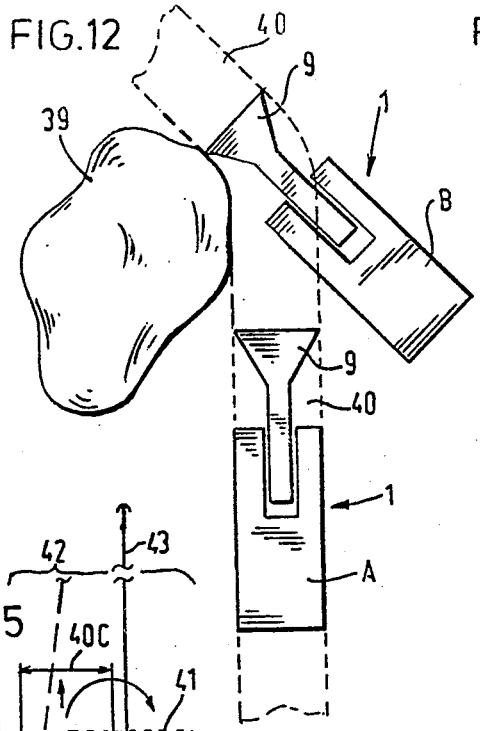
Figure 13:
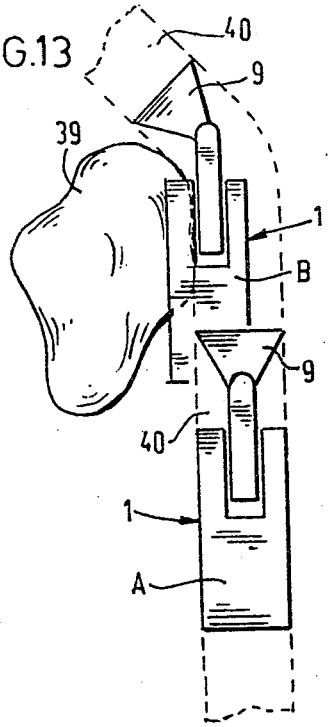

FIGS. 7, 9 and 10 control-means for adjusting water jets of the dredger shown in FIG. 1.

Figure 18:
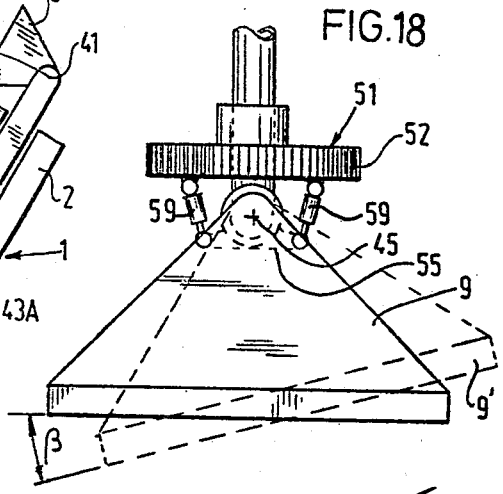
Figure 19:
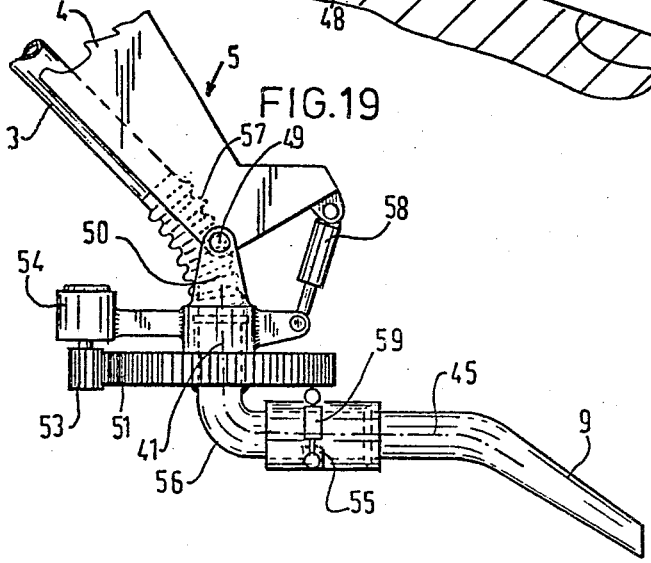

FIGS. 12 to 17 some variants of the dredger according to the invention, by which consecutive and uninterrupted paths respectively are worked, FIGS. 18 and 19 the moving mechanisms of suction heads about different axes of the suction head with respect to the direction of suspension.

Figure 20:
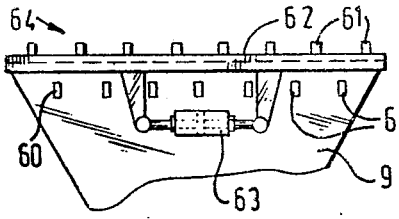
Figure 20A:
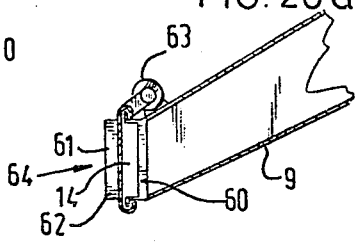
Figure 21:
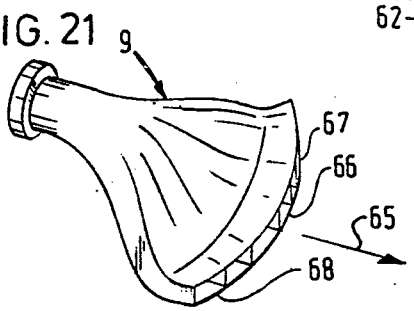
Figure 22:
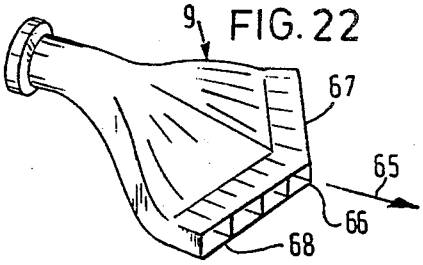
Figure 23:
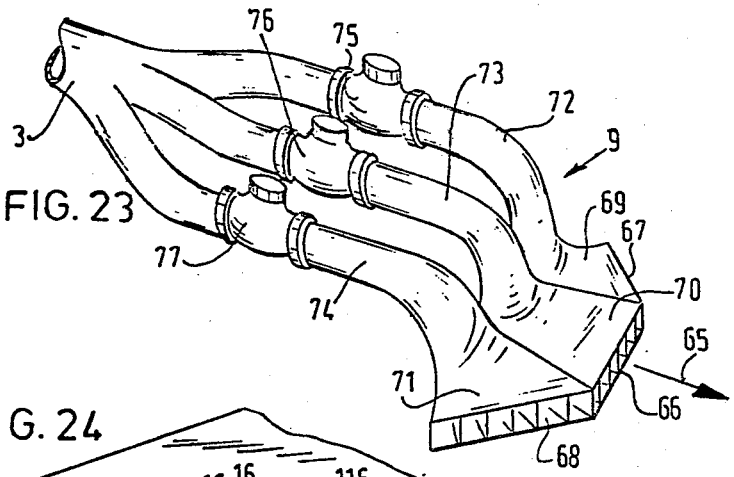
Figure 24:
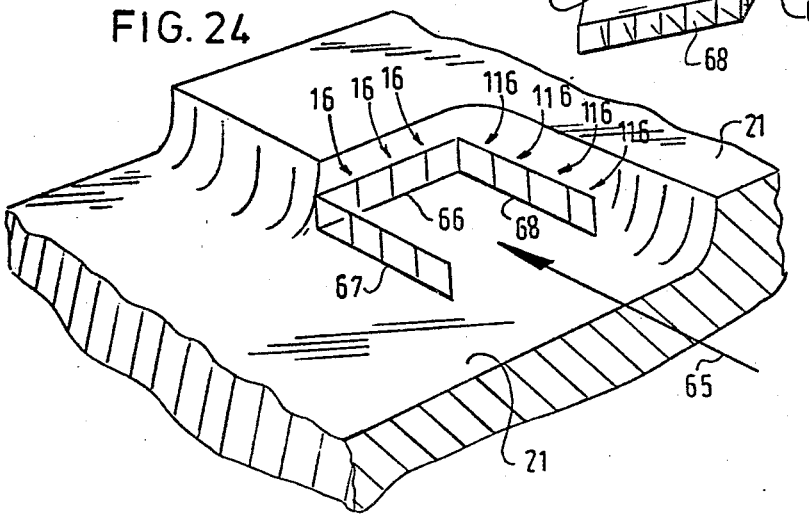

FIGS. 20 and 20A a mechanical cutting device for sticky or suchlike impurities.

FIGS. 21 to 26 and FIG. 31 each a further development of a dredger in accordance with the invention.

Figure 27:
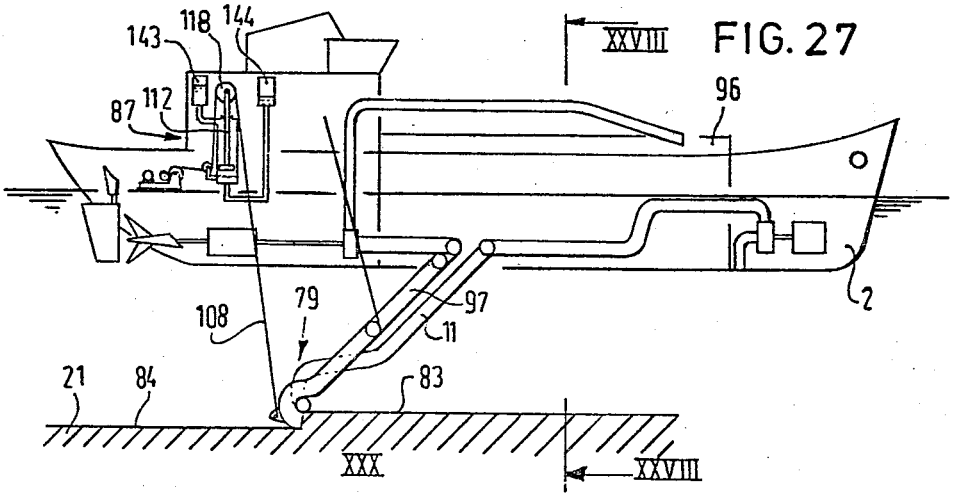

FIG. 27 a side elevation of a dredging implement embodying the invention constructed in the form of a suction dredger.

Figure 28:
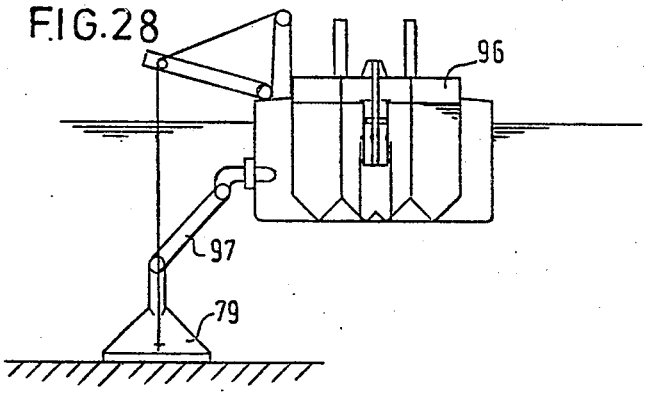

FIG. 28 a sectional view taken on the line XXVIII—XXVIII in FIG. 27.

Figure 29:
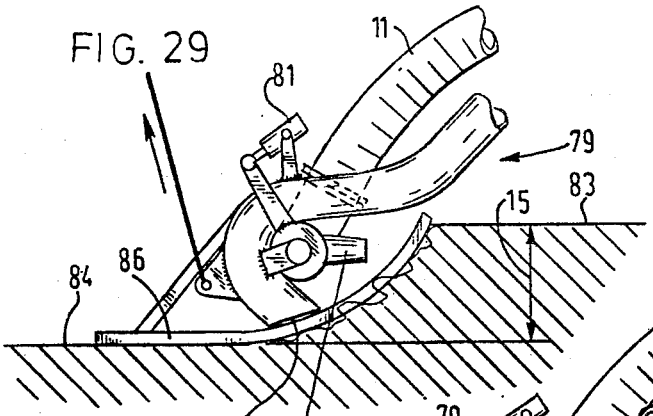
Figure 30:
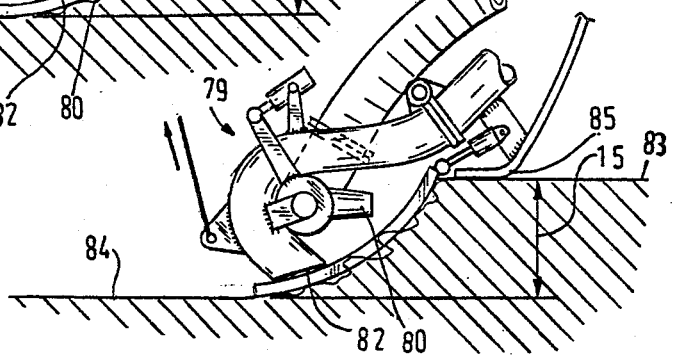

FIGS. 29 and 30 each a variant of detail XXX of FIG. 27 and

Figure 31:
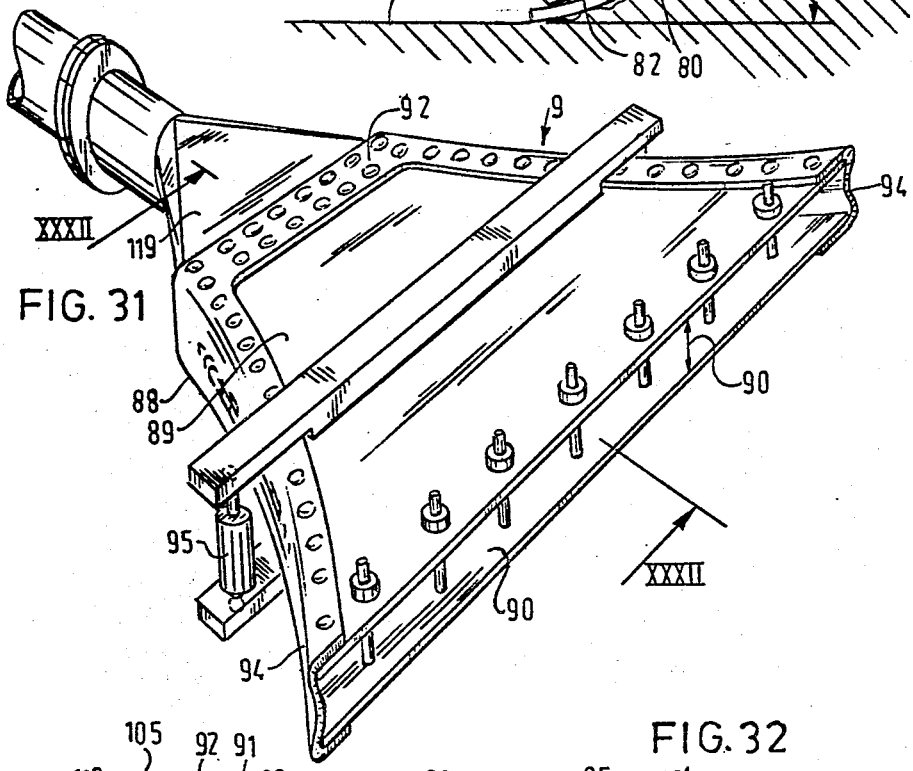
Figure 32:
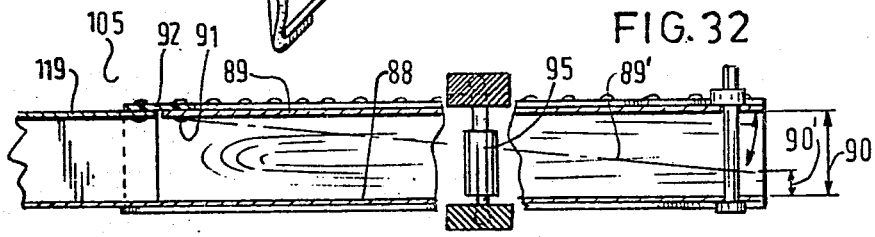

FIG. 32 a sectional view taken on the line XXXII—XXXII in FIG. 31.

Referring to FIGS. 1 and 2 the dredger 1 comprises a floating body 2, a transport conduit 3 connected with said floating body 2, a ladder 4 pivotable about a horizontal axis 120, connected with the floating body 2 and being carried by the floating body 2 by means of a cable 108, a broad suction head 9 fastened to the ladder 4 and communicating with the transport conduit 3, a water supply conduit 11 having a water inlet 106 for outboard water 105, a water pump 7 driving by a driving device 8 and feeding water to a distribution pipe 12 extending in the direction of width of the suction head 9 and comprising water jet tubes 10 mounted on the distribution pipe 12 and distributed in the direction of width of the suction head 9. The transport conduit 3 includes a subaqueous pump 6, which like a portion of the transport conduit 3, the water supply conduit 11 and the water pump 7 is carried by the ladder 4. The ladder 4 and the cable 108 constitute the suspension means for suspending the suction head 9 to the floating body 2.

At the front side 13 the suction head 9 has an elongated suction slot 14 extending in the direction of width of the suction head 9 for admitting to the suction head 9 the fluidized ground 16 loosened from a ground layer 15 by means of the water jet tubes 10.

In order to obtain an optimum dredging process (FIG. 3) even in different angular positions of the ladder 4 and with different associated suction depths 17A, 17B of the suction head 9, the water distributing pipe 12 is pivotally connected at both ends with the suction head 9 in pivot bearings 18. A setting mechanism 19 consists of a rack-pinion mechanism shown only in FIG. 2, which is actuated for obtaining the correct setting angle of the water jet tubes 10 via control-means 25 arranged on board of the floating body 2.

If the ground 16 allows for a larger layer height 15A to be obtained it is advantageous in accordance with the invention, that the water jets 27, 28 can be directed with greater efficiency to the layer 15 by increasing the energy and/or changing the direction of the water jets 27, 28. In order to maintain in this case the correct magnitude of the water jet pulses 27, 28 particularly in the event of a bottom 21 having different kinds of ground compositions the power available on board for the water jet tubes 10 is utilized in accordance with the invention with greater efficiency when the water pump driving device 8 is arranged so as to be controllable, whilst the power remains the same. The driving device 8 may comprise a change-speed gear 22 and control-means (not shown) arranged on board the floating body 2. The driving device 8 ensures that the water is supplied to the water jet tubes 10 with a predetermined energy.

Figure 3:
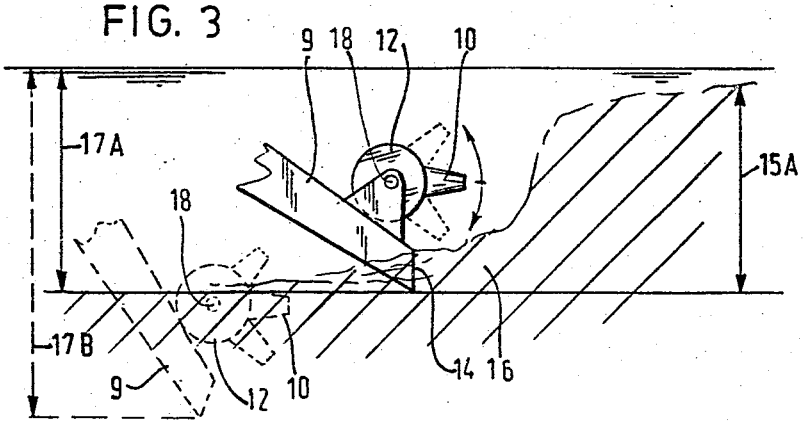
Figure 4:
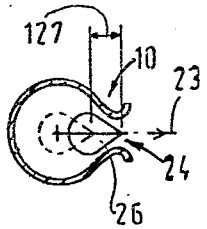
Figure 5:
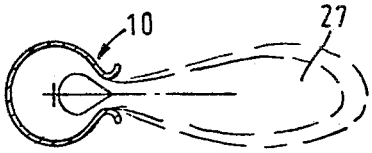
Figure 6:
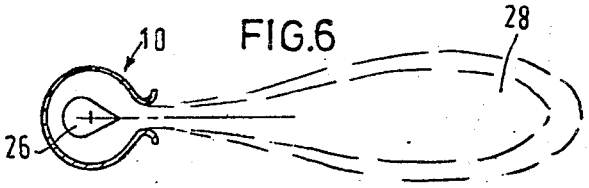

In order to further control the jet 23 of the water at least a few of the water jet tubes 10 have passage controlling means 24. FIGS. 3 to 5 illustrate schematically in order of succession the construction of the water jet tubes 10 with a flow guide 26 and in order to control the pulses of the water jets 27, 28 as shown in FIG. 5 said flow guide 26 can be set back over a distance 127 to a greater rate at the water jet 28 the pressure remaining substantially the same. In the latter case the water having the higher pulse (having a higher specific energy) is sprayed against the ground layer 15, thanks to the well-controlled water supply, and causes even a hard-packed ground to fluidize, so that a higher production can be obtained. The direction of the water jets 27, 28 is important with a view to the obtained bulk of fluidized ground and to passing the same readily into the suction slot 14.

The production is also determined by an adequate rate of displacement of the suction head 9 with respect to the ground and by an adequate height of the layer 15A. If at a lower rate of displacement the ground compositions allow for a greater height of the layer 15A, it may be important to constantly vary the water jet tubes 10 in a direction of height so that a constant supply of fluidized ground to the suction slot 14 can be ensured.

FIG. 7 shows in further detail the passage control-means 24. The control 29 on board the floating body 2 provides the inlet and outlet of fluid into and out of respectively a hydraulic ram 30, which brings about the linear displacement of the flow guide 26.

Figure 8:
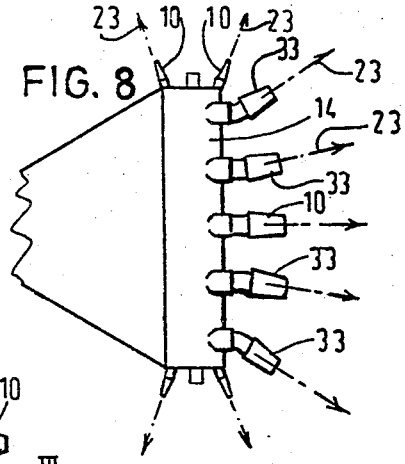

With certain types of ground it may be advantageous to attack the ground 21 at different angles by means of the water jets 27 and 28. FIGS. 8 to 10 show a plurality of jet tubes 33, apart from the fixed jet tubes 10, provided with individual setting means 31 comprising a flexible conduit portion 32, a compression spring 34 and setting cylinders 35 and 36 for sweeping to and fro the water jet tubes 33 in two orthogonal directions. This disposition is particularly important when some impedance formed, for example, by clay or peat has to broken up by the water jets. The hydraulic control-means (not shown) corresponding with those in FIG. 7 are located on board the floating body 2.

Figure 11:
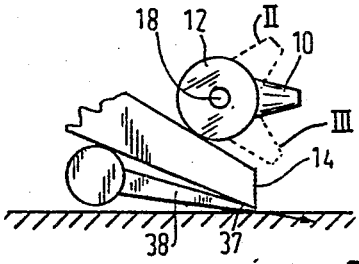

In order to facilitate the insertion of the suction head 9 into the ground water jet tubes 38 are mounted, as shown in FIG. 11, along the lower edge 37 of the suction slot 14. Moreover, also the water jet tubes 10 are rendered angulaarly adjustable to the position III, in which the water jet is downwardly operative as far as beyond the lower end 37.

Referring to FIG. 9 the jet nozzle is provided with an elastic, for example, rubber tip 110 which during the operation of a water jet 111 deflects into the position 110' indicated by broken lines.

If during the execution of a job (FIG. 12) the suction head 9 encounters an obstacle 39, for example, a rock, the dredging implement 1 can be turned from the position A to the position B in order to avoid disturbances during the operation. Then the path 40 can be dredged.

Figure 15:
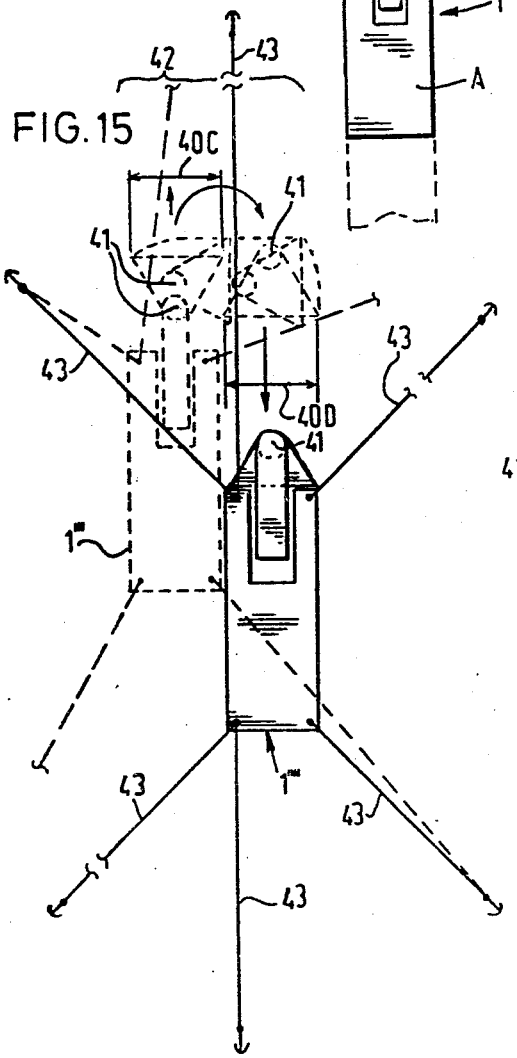
Figure 14:
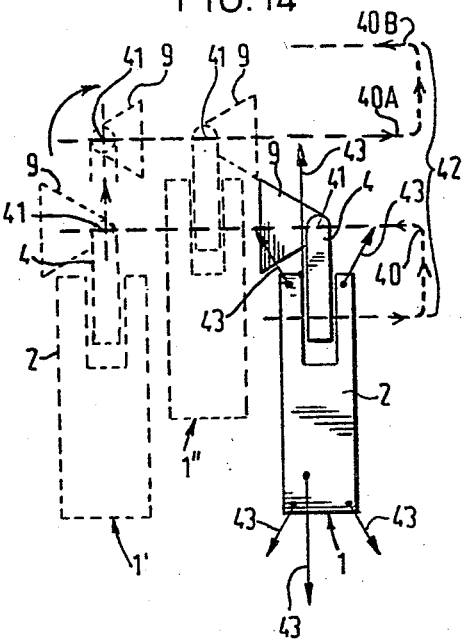

In order to allow less complicated manoeuvring and to work more economically in other ways, for example, while maintaining the same anchor position, the suction head 9 is fastened to the ladder 4 so as to be pivotable about a standing axis 41, as is shown in FIGS. 14 and 15. It is thus possible to avoid an obstacle 39 without much circuitous manoeuvring, while a "field" 42 can be worked, as will be apparent from FIGS. 14 and 15. Referring to FIG. 14 by hauling the dredging implement 1 in its anchorage carrier 43 along parallel paths 40, 40A, 40B etc. the field 42 is worked, the position of the suction head 9 being each time changed by 180 degrees at the change-over from one path to the other. FIG. 15 illustrates a similar position in which the dredging implement 1 is hauled invariably in the direction of length, while paths 40C and 40D and so on are worked.

Figure 16:
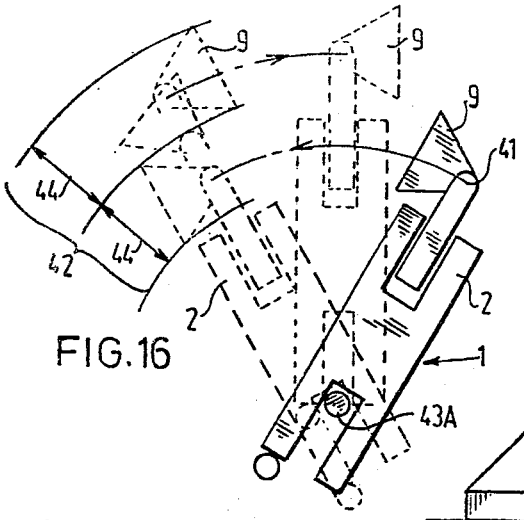

FIG. 16 illustrates a further variant of the embodiment shown in FIG. 14, in which the dredging implement 1 turns about an anchorage pile 43A and thus works the field 42 along successive, curved paths 44 in opposite directions, the positions of the suction head 9 being adapted.

Figure 17:
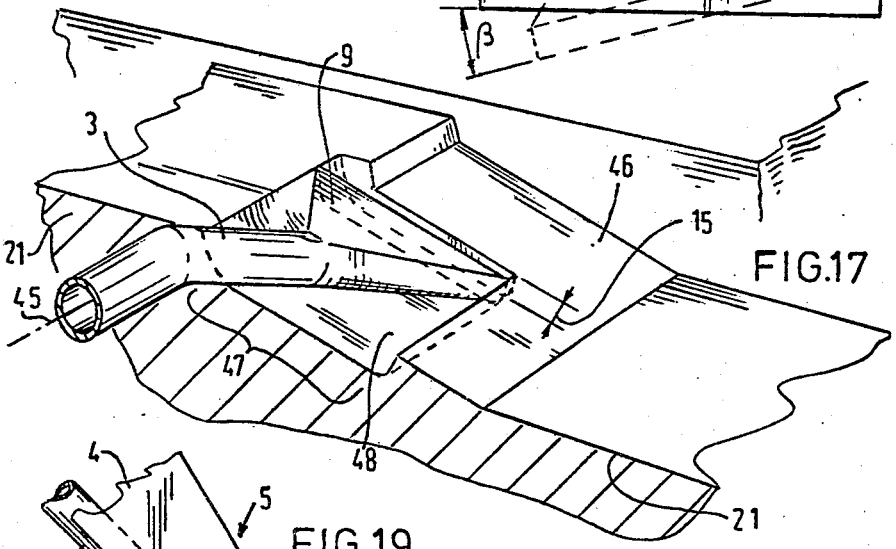

FIG. 17 shows perspectively how a ground 21 is worked owing to the turn of the suction head 9 about a lying axis 45 along a talus 46, while with a layer depth 15 in successive paths 47 of the slope a flat bottom 48 with the prescribed inclination is obtained.

FIGS. 18 and 19 show further details of the moving mechanisms. The ladder 4 is provided with a pivotal arm 50 on a lying shaft 49 to which is suspended a lying dish 51 with a toothed crown 52 co-operating with a pinion 53 driven by a motor 5. The section head 9 is suspended so as to be angularly adjustable by means of hydraulic rams 59 about a lying axis 45 in a wedge 55 on the dish 51, communication via a bend 56 and a flexible conduit portion 57 with the ground transport conduit 3. The angular adjustment of the dish 51 with respect to the ladder 4 is brought about by hydraulic rams 58.

In order to be able to remove more effectively sticky or upper clogging ground parts the suction slot 14 preferably comprises knives 60 (see FIGS. 20 and 20A) with co-operating counterknives 61, which can be reciprocated with a frame 62 by means of hydrometers 63. The assembly 64 serves in normal suction operations as a suction basket and may be used together with the water jet tubes 10 to reduce larger lumps of ground to suctionable ground particles. The hydromotors 63 are controlled by means (not shown) actuated by means on board the floating body 2.

FIGS. 21 to 24 show several further developments of suction heads 9 of the dredging implement 1 according to the invention providing an improvement in the execution of dredging jobs in a plurality of consecutive opposite runs along successive paths. For this purpose the suction 9 has—viewed in the direction of movement 65—a foremost nozzle part 66 and at least one second suction nozzle part 67 and 68 respectively re-entered with respect to the former. Thus a sand mass 116 still flowing after a sucked layer has been passed over can be sucked up (see FIG. 24). In order to be able to dredge along successive paths without relative movements between the ladder 4 and the suction head 9 a further developed variant of the suction head 9 shown in FIG. 23 comprises suction head parts 69, 70 and 71 corresponding with the suction nozzle parts 66, 67, and 68 and separated from one another, each of which communicates with the ground transport conduit 3 through separate outlets 72, 73 and 74 through closing members 75, 76 and 77. In the working position shown in FIG. 24 the closing members 76 and 77 are opened and the closing member 75 is closed.

Figure 25:
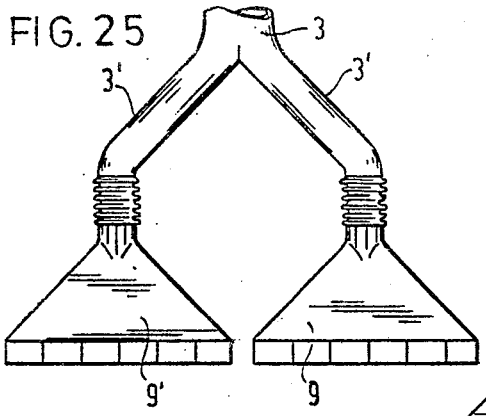
Figure 26:
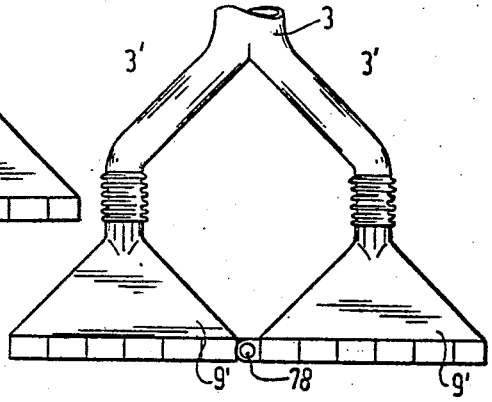

A further developed variant of the dredging implement embodying the invention comprises "linked" or "loose" suction heads 9' as shown in FIGS. 25 and 26. Referring to FIG. 26 the to suction heads 9' are interconnected through ball-and-socket hinges 78 and communicate each through conduit portions 3' with the transport conduit 3. When the dredging implement 1 according to the invention is used as a suction dredger (see FIGS. 27 to 30), the dredging implement 1 comprises a hold 96 for the dredged material and a trailed tube 97 provided with a water inlet conduit 11. The water jet tubes 80 are mounted along the upper edge of the suction slot 82 so as to be angularly adjustable by means of hydraulic rams 81. The suction head 79 constructed in the form of a dragged head can bear on the bottom 83 above the layer 15 or on the dredged bottom 84 by means of supports 85 and 86 respectively. The suction slot 82 is inclined downwards.

In order to reduce the effect of waves the suction head 9 is suspended to the floating body 2 by means of a swell compensator 87 and a cable 108. The cable 108 is passed over a disk 118 supported by a piston rod 112. On the one hand the level of the piston rod 112 is determined by a low-pressure chamber 144 which ensures a stretched position of the cable 108 when the floating body 2 is fluctuating and the suction head 79 bears on the bottom 83, whereas on the other hand the high-pressure chamber 143 will give off a length of cable 108 not until the cable 108 is heavily loaded. In this way the suction head 79 is maintained at a predetermined depth.

In order to maintain the rate of flow of the mixture at the suction slot 90 and in the suction head 9 above the critical rate for the material concerned, in the event of different kinds of ground material, the suction head 9 is a further developed, preferred embodiment of the dredging implement 1 according to the invention comprises a lower rim 88 and an upper rim 89 bounding between them a suction slot 90 at the front of the suction head 9, the upper rim 89 being pivoted to the rear portion 119 of the suction head 9 by means of hinges 91 for adjusting the width of the suction slot 90. The hinge 91 seals the suction head 9 by means of a rubber flap 92 from the outboard water 105. The side walls 94 are also made of rubber-like, flexible material. The desired slot width is adjusted by means of hydraulic rams 95, which accurately determine the distance between the lower rim 88 and the upper rim 89.

The term "specific energy" of the water jet is to denote the energy per square centimeter of the water jet. This specific energy can be varied by changing the passage of one and the same nozzle or by changing the number of opened nozzles and a plurality of nozzles communicating with the source of pressurized water.

What we claim is:

1. The method of removing a selected top layer of subaqueous material while leaving the material underlying such layer in essentially undisturbed condition, which comprises the steps of:

(a) providing a suction inlet mouth of elongate, flattened form and traveling such mouth along a particular path which is overburdened by the top layer of subaqueous material to be removed, (b) forcibly directing water ahead of the suction inlet mouth in the direction of travel thereof and during the traveling of step (a), and (c) controlling the direction and the energy of the water directed in step (b) to fluidize substantially only the material of said top layer and thereby leave a well defined and smooth surface of the underlying material which is parallel to said path.

2. The method as defined in claim 1 wherein the direction of the water is cyclically varied in step (c).

3. The method as defined in claim 1 or 2 wherein the energy of the water is varied in step (c).

4. The method as defined in claim 1 or 2 wherein said path is of zig-zag form.

5. A dredging implement comprising, in combination:

suction head means defining a suction inlet mouth of elongate, flattened form, conduit means extending from said suction head for directing a suspension of sand in water from said inlet mouth to a remote location, and pump means for conveying such suspension through the inlet mouth and the conduit means;

means for traveling said suction head along a particular path beneath the level of a body of water, which path is overburdened by a layer of sand which is to be removed;

nozzle means for forcibly discharging water ahead of said suction head in the direction of and during movement thereof to fluidize the material of said layer; and means controlling the direction and energy of the water discharged by said nozzle means for fluidizing substantially only the material of said layer.

6. The dredging implement as defined in claim 5 wherein said suction head is pivotally mounted about a vertical axis and including means for pivoting said suction head to different angular positions about said axis.

7. The dredging implement as defined in claim 5 including means for oscillating said nozzle means in a vertical plane.

8. The dredging implement as defined in claim 5 including means for oscillating said nozzle means in a horizontal plane.

9. The dredging implement as defined in claim 5 including means for oscillating said nozzle means in orthogonal planes.

10. The dredging implement as defined in claim 5 including means for adjusting said nozzle means angularly about a horizontal axis.

* * * * *